US008070022B2

(12) United States Patent
Briles

(10) Patent No.: US 8,070,022 B2
(45) **Date of Patent: *Dec. 6, 2011**

(54) APPARATUS FOR DISPENSING A MEASURED AMOUNT OF PASTE

(76) Inventor: Franklin S Briles, Fallbrook, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/980,316

(22) Filed: Dec. 28, 2010

(65) Prior Publication Data

US 2011/0089199 A1 Apr. 21, 2011

Related U.S. Application Data

(63) Continuation of application No. 12/540,304, filed on Aug. 12, 2009, now Pat. No. 7,882,989.

(51) Int. Cl.
*G01F 11/20* (2006.01)

(52) U.S. Cl. ..... 222/356; 222/369; 141/370

(58) Field of Classification Search ..... 222/356, 222/363, 322, 456, 369; 141/370
See application file for complete search history.

(56) References Cited

U.S. PATENT DOCUMENTS

| | | | | | |
|---|---|---|---|---|---|
| 1,411,000 | A * | 3/1922 | Condon | ..... | 222/305 |
| 1,710,233 | A * | 4/1929 | Collins et al. | ..... | 222/248 |
| 1,967,448 | A * | 7/1934 | Olson | ..... | 222/364 |
| 2,063,288 | A * | 12/1936 | Allen, Jr. | ..... | 141/360 |
| 3,289,885 | A * | 12/1966 | Villaveces | ..... | 221/288 |
| 3,985,274 | A * | 10/1976 | Lubalin et al. | ..... | 222/362 |
| 6,585,136 | B1 * | 7/2003 | Stern | ..... | 222/336 |

* cited by examiner

*Primary Examiner* — Kevin P Shaver
*Assistant Examiner* — Donnell Long
(74) *Attorney, Agent, or Firm* — Thomas D. Foster; M. Reza Savari

(57) ABSTRACT

An apparatus, system, and method for dispensing a measured amount of paste is provided herein, including a flexible container for paste, comprising a closed end, a peripheral wall, and an open outlet; a top cap comprising a top surface and a bottom surface, the top cap hingedly attached to the open outlet, the bottom surface of the top cap disposed to cover the open outlet in a closed position and uncover the open outlet in an open position; and a scooper attached to the bottom surface of the top cap in a substantially perpendicular orientation, the scooper configured to dip into the container in the closed position and scoop out a measured amount of paste from the container in an open position.

20 Claims, 3 Drawing Sheets

APPARATUS FOR DISPENSING A MEASURED AMOUNT OF PASTE

CROSS REFERENCE TO RELATED APPLICATIONS

This application is a continuation of application Ser. No. 12/540,304, filed Aug. 12, 2009, which is incorporated herein by reference in its entirety.

FIELD OF INVENTION

The present invention generally relates to paste dispensers, and particularly to an apparatus and system for dispensing a measured amount of paste.

BACKGROUND OF THE INVENTION

Paste or paste-like materials have many uses and are utilized in a variety of field including construction, paint, art, medicine, and hygiene. Many times these pasty material are provided in tubes having a small opening through which the paste is squeezed out. A user normally makes an estimate of how much paste is required for a particular job, squeezes out what may appear to be the required amount, and uses the dispenses paste. Many times, the user overestimate the amount of paste needed and dispenses more paste than needed, and because the paste cannot easily be put back inside the tube, the extra paste ends up as waste. When using certain types of pastes, such as artist's paint or toothpaste where only a relatively small amount of paste is required at a time, waste of material is a normal and accepted outcome.

While there has been a trend to provide more user-friendly paste dispensers, further improvements in waste reduction and control over the amount of the dispensed paste are desirable. As can be seen, there is a need for a more effective and efficient paste dispenser.

SUMMARY OF THE INVENTION

The present invention provides a new apparatus and system for dispensing a measured amount of paste.

One aspect of the present invention includes an apparatus for dispensing a measured amount of paste, including a flexible container for paste, comprising a closed end, a peripheral wall, and an open outlet; a top cap comprising a top surface and a bottom surface, the top cap hingedly attached to the open outlet, the bottom surface of the top cap disposed to cover the open outlet in a closed position and uncover the open outlet in an open position; and a scooper attached to the bottom surface of the top cap in a substantially perpendicular orientation, the scooper configured to dip into the container in the closed position and scoop out a measured amount of paste from the container in an open position.

Another aspect of the present invention includes a system for dispensing a measured amount of paste, including a squeezable paste container having an open end; a cap comprising an elongated lip attached at a substantially perpendicular orientation; and a hinge connecting the cap to the open end of the paste container, wherein the cap covers the open end of the paste container in a closed position and uncovers the open end of the paste container in an open position; wherein the elongated lip of the cap dips into the paste container when the cap is in the closed position and scoops out a measured amount of paste from the paste container when the cap moves to the open position.

Yet another aspect of the present invention includes a method for dispensing a measured amount of paste, comprising the steps of: providing a flexible container for paste with an open outlet; providing a top cap hingedly attached to the open outlet for opening and closing the open end, the top cap comprising a substantially perpendicular scooper, the scooper configured to dip into the container and scoop out a measured amount of paste from the container while moving toward an open position; and dispensing a measured amount of paste from the container by opening the top cap from a closed position

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views.

DETAILED DESCRIPTION OF THE INVENTION

Figure 1:
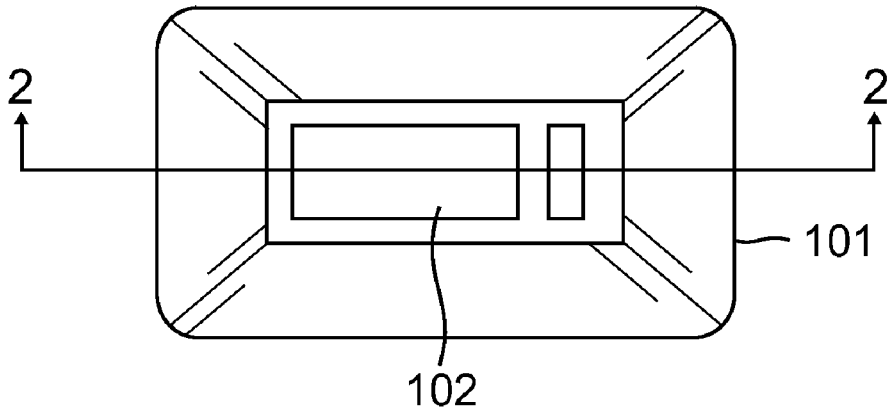
FIG. 1 shows a top view of an exemplary embodiment according to the present invention with the cap in the closed position.
Figure 2:
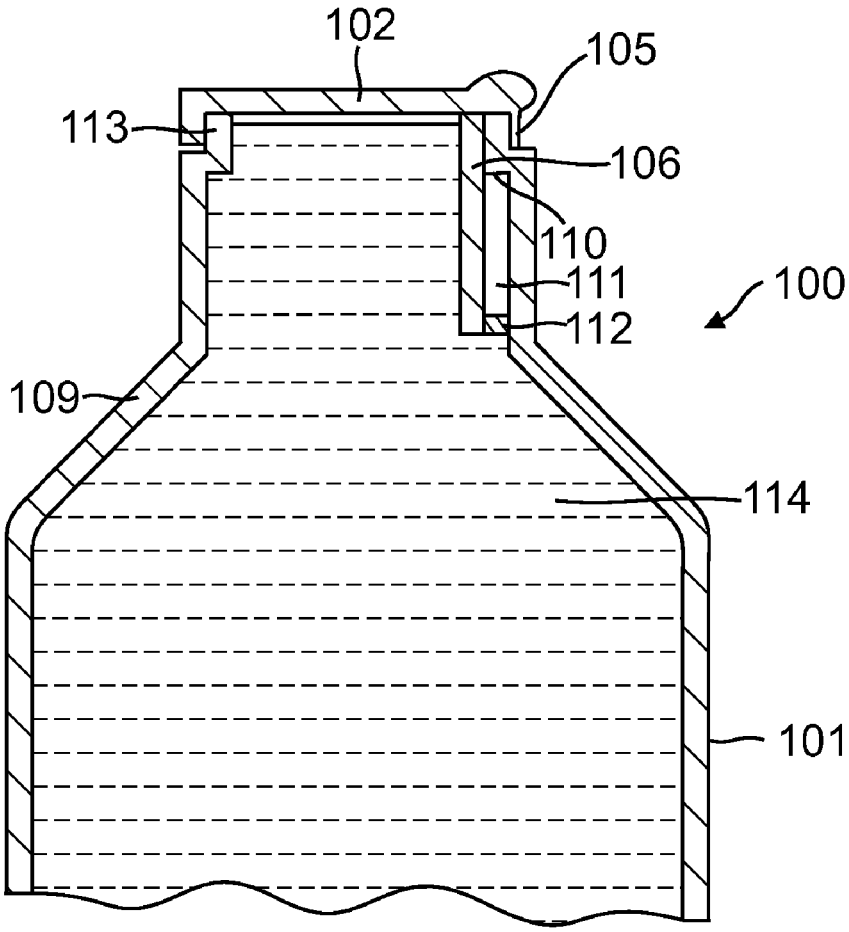
FIG. 2 shows a section side view of an exemplary embodiment according to the present invention taken along line 2-2 in FIG. 1.

Further objectives and advantages of the present invention will become apparent as the description proceeds and when taken in conjunction with the accompanying drawings. To gain a full appreciation of the scope of the present invention, it will be further recognized that various aspects of the present invention can be combined to make desirable embodiments of the invention. Unless defined otherwise, all technical and scientific terms used herein have the same meaning as commonly understood by one of ordinary skill in the art to which this invention belongs. Where a term is provided in the singular, the inventor also contemplates the plural of that term. The nomenclature used herein and the procedures described below are those well known and commonly employed in the art. Referring to FIGS. 1-4, one embodiment of the present invention 100 includes an apparatus for dispensing a measured amount of paste 114. The paste that can be dispensed with the present invention 100 may by any type of paste, including pastes used in construction material, paint, art, medicine, and hygiene. It should be recognized that paste can be any soft mixture or composition, which may include creams, viscous liquids, and gels, which may or may not include solids such as granules. For example, the present invention 100 can be particular adaptable as a toothpaste dispenser.

The present invention 100 includes a flexible container 101 for containing the paste 114 to be used when desired. The paste container 101 may be in any shape or form that is desired or suitable for dispensing a particular type of paste, for example, the container 101 may be rectangular, round, square, oval, or any other shapes. The flexible container 101 may be squeezed to manipulate the paste within, such as squeezing the paste from a lower part of the container 101 to an upper area that would be more easily accessible. The container 101 may be made from any flexible squeezable material, such as plastic, rubber, metal, or a combination thereof. The flexible container 101 may have a closed end (not shown), a peripheral wall, and an open outlet 108. The open outlet 108 may be an open end defined by the peripheral wall at the open end of the paste container, or the open outlet 108 may be a separate piece, such as an attachable cap for the paste container.

The container 101 of the present invention 100 may include a top cap 102 for opening and closing the open end of the container 101. The top cap 102 may include a top surface 103 and a bottom surface 104, and the top cap 102 may include a hinge 105 or be hingedly attached to the open outlet 108 or open end of the container 101. The bottom surface 104 of the top cap 102 can be disposed to cover the open outlet 108 of the container 101 in a closed position and uncover the open outlet 108 in an open position.

A scooper 106 may be attached to the bottom surface 104 of the top cap 102 in a substantially perpendicular orientation. The scooper 106 may have a concave, convex, or flat shape or configuration on its surface to scoop more of the paste 114, or its configuration may be that of an elongated lip with a flat surface. The scooper 106 may further include a side-wall 116 along each of the lengths of the top surface of the scooper 106 in order for the paste 114 to be more easily scooped out of the container 101 for application. For example, the side-walls 116 of the scooper 106 may have a height of between about 1/16 inches to 1/4 inches, and for application of the present invention as a toothpaste container, the sides-walls 116 of the scooper 106 may have a height of between about 1/16 inches to 1/4 inches. The length and width of the scooper 106 can vary in order to permit variation in the volume of paste that is dispensed as desired or suitable for particular applications. For example, application of the present invention 100 as a dispenser for toothpaste may include a scooper 106 having a length of between about 1 inch to about 1 1/2 inches and a width of between about 1/4 inches to about 1/2 inches. For example, the scooper 106 may have a length of 1 1/4 inches and a width of 3/4 inches. The scooper 106 being substantially perpendicular to the bottom surface 104 of the top may be exactly perpendicular, or be more or less than exactly perpendicular, for example by between about 1 to about 30 degrees in either direction. The scooper 106 can be configured to dip into the container 101 when the top cap 102 is placed in the closed position by a user, and scoop out a measured amount of paste 114 from the container 101 while being opened by the user to an open position. With such a configuration, a user only uses that amount of paste 114 that is necessary or desired, and if there is any paste left over, the extra paste can remain on the scooper 106 and be returned to the container 101, and thus eliminating any waste of the paste.

Figure 5:
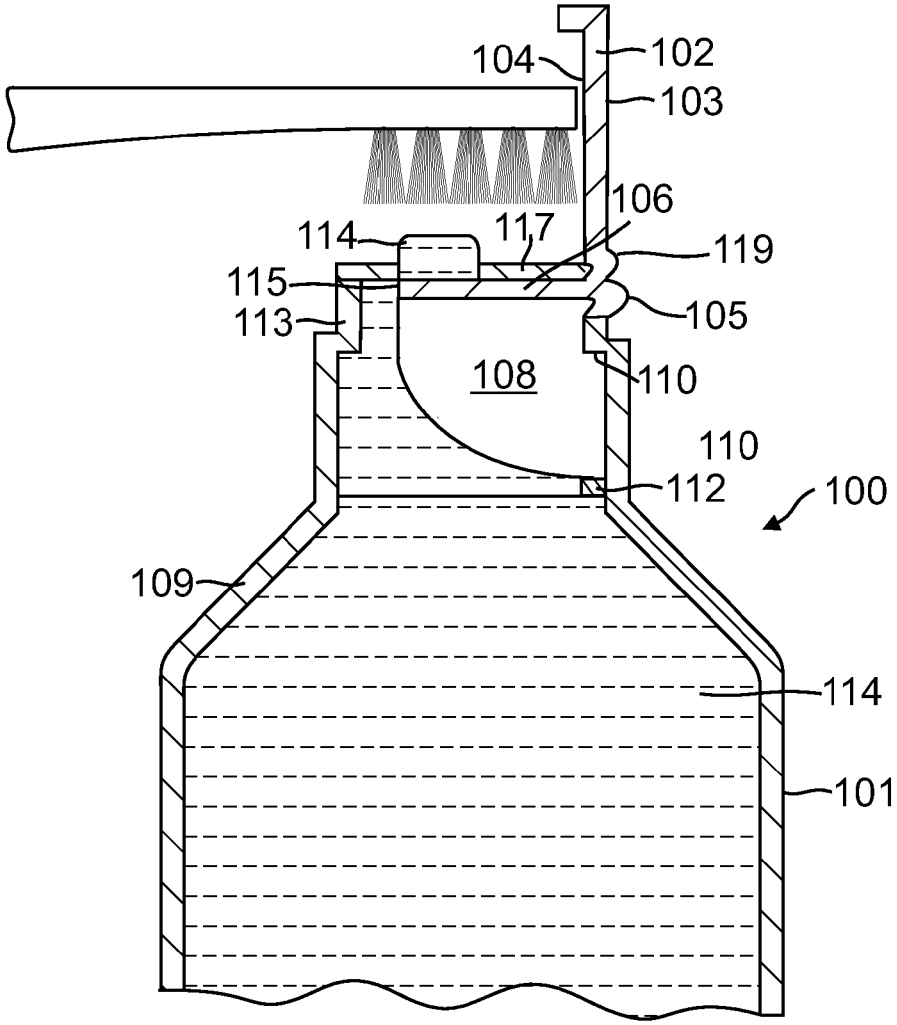
FIG. 5 shows a section view of an exemplary embodiment according to the present invention with the cap in the open position taken along line 5-5 in FIG. 6.
Figure 6:
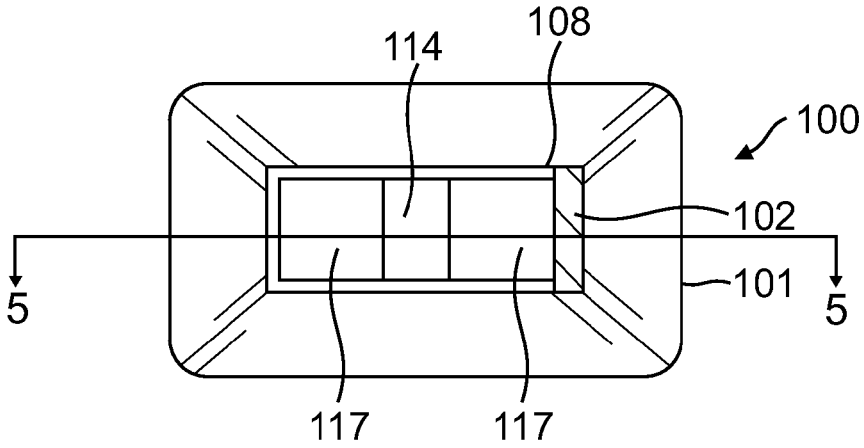
FIG. 6 shows a top view of an exemplary embodiment according to the present invention with the cap in the open position.

Referring now to the embodiment shown in FIGS. 5 and 6, the open outlet 108 may also include a substantially flat panel 117 extending fully or partially from one end where the hinge 105 may be located to the opposing end where the engaging means 113 may be located. The flat panel 117 may also include anther hinging means 119 such as an integral or separable hinge or a cavity that allows the top cap 102 and the scooper 106 to move about the flat pane 117 without hindering their motion. The flat panel 117 may include one or more exit means, such as holes, apertures, orifices, or the like that are configured in the flat panel 117, such that the paste is pushed toward the open end 108 by the scooper 106 and is able to exit through the one or more exit means. The purpose of the flat panel 117 includes holding back and blocking excess paste 104 from exiting from the open end 108 of the container 101 by the scooper.

Generally, the open outlet 108, the top cap 102, and the scooper 106, each may have any shape and configuration that is suitable for its intended use. For example, if the present invention 100 is intended as a container 101 for toothpaste, the outlet 108, the top cap 102, and the scooper 106 may all have substantially rectangular-shaped configurations. This is helpful for application as a toothpaste container 101 because the majority of toothbrushes have a substantially rectangular head where toothpaste is applied, and by providing a substantially rectangular open outlet 108 and scooper 106, only the desired amount of toothpaste can be dispensed from the container 101 and substantially evenly applied to the entire head of the toothbrush. The container 101 may be stored by placing the top surface 103 of the top cap 102 on a flat surface, so that the paste 114 is readily available at the open outlet 108 area where the scooper 106 can easily bring out the paste 114 from the container 101 to be used.

Figure 3:
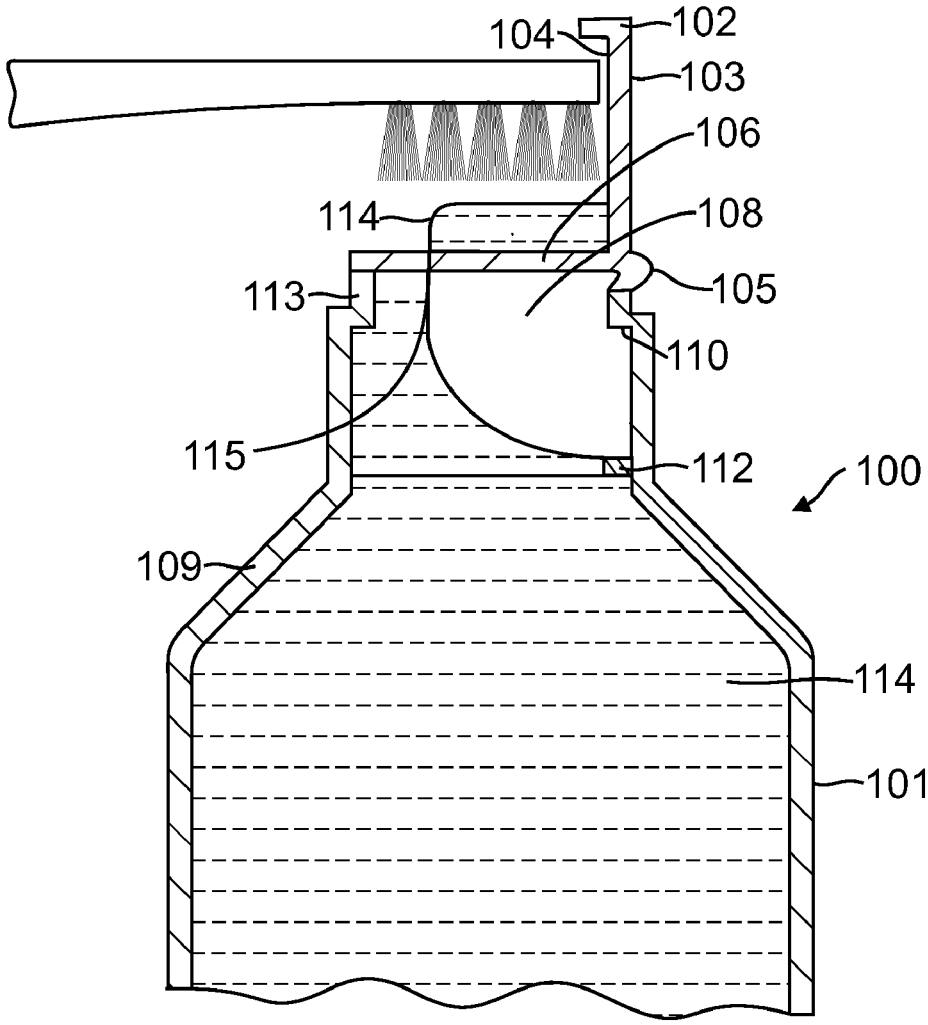
FIG. 3 shows a section view of an exemplary embodiment according to the present invention with the cap in the open position taken along line 3-3 in FIG. 4.
Figure 4:
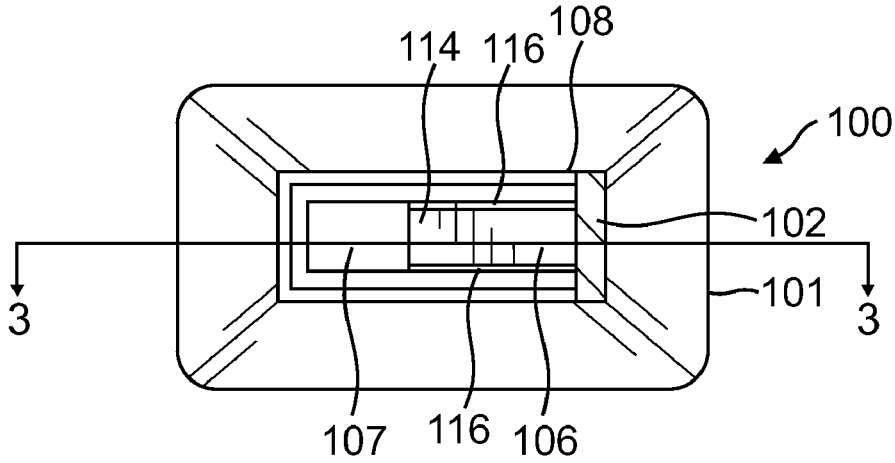
FIG. 4 shows a top view of an exemplary embodiment according to the present invention with the cap in the open position.

In some embodiments, it may be desirable for the scooper 106 to be shorter in length than the length of the top cap 102. In such a configuration the shorter scooper 106 is able to provide an open area 107 and leaving an opening in the open outlet 108 when the top cap 102 is in the open position as shown in FIG. 4. In other embodiments, the scooper 106, in the open position may be flushed against the inner wall at the open outlet 108 or flushed against a lip 115 extending from the inner wall at the open outlet 108 as shown in FIG. 3.

Embodiment of the present invention 100 may include any suitable or desired shapes and configurations. For example, the peripheral wall of the container 101 may taper 109 to the open outlet 108. For example, the tapering of the container 101 wall may be only on one side or the entire periphery or circumference of the container 101 wall may taper 109 toward the open outlet 108. Tapering may start from the bottom end of the container 101 and continue to the open outlet 108, or the tapering may be at a location along the length of the container 101 wall, such as beginning at some distance before the open outlet 108, for example beginning from about one third of the length of the container 101 from the opening.

With respect to the open outlet 108 of the container 101, the peripheral wall defining the open outlet 108 may end at the opening where the top cap 102 can be integrally hingedly attached, for example by way of a strap hinge 105, or is attached utilizing a separate hinge mechanism for closing and opening the open end of the container 101. In an alternative embodiment, the open outlet 108 may further include an extension member 110 or a spacer positioned toward the open outlet 108 which contacts the scooper 106 when the top cap 102 is in the closed position. The extension member 110 or spacer may be a raised surface located on all or a partial surface of the inner wall, anterior or in front of where the hinge 105 is located toward the open end. With such a configuration, the scooper 106 may be attached to the bottom surface 104 of the top cap 102 at a distance away from the end of the top cap 102 where the top cap 102 is joined to the open outlet 108 by way of the hinge, wherein the extension member 110 allows for a space 111 to be provided behind the scooper 106 and the peripheral wall. Thus in such an embodiment, the inner surface of the peripheral wall of the open outlet 108 is not in direct contact with the back side of the scooper 106 when the top cap 102 is in a closed position, and instead the back side of the scooper 106 contacts the extension member 110 leaving a space 111 between the back side of the scooper 106 and inner surface of the peripheral wall of the open outlet 108. Moreover, a seal 112 may be provided and positioned toward the open outlet 108 which contacts the scooper 106 when the top cap 102 is in the closed position and keeps paste from building up in the space 111 behind the scooper 106. Such a seal 112 may be integral to an area of the inner surface of the peripheral wall toward the open outlet 108, or may be a separate piece. The seal 112 is positioned to keep paste from building up behind the scooper 106 in the space 111 created by the extension member 110.

The open outlet 108 and the top cap 102 may further include complementary engaging means 113 or releasable securing means to releasably secure the top cap 102 in the closed position. Any suitable complementary engaging mean 113 or releasable securing means may be used, for example, fasteners such as male-female fasteners or retainers such as snap-lock retainers. Other types of releasable engaging or securing means are also contemplated, such as spring-loaded fasteners or retainers. Some of the retainers or fasteners, such as friction retainers may only use friction to keep the top cap 102 secured to the open outlet 108.

The paste dispenser of the present invention 100 may also include a stop or a guide for the top cap 102 in order for the top cap 102 to stop at a certain position when being opened, such as in a vertical position. Furthermore, a releasable locking mechanism can also be provided for the top cap 102 such that the top cap 102 can remain open in the desired position when the paste is dispensed during operation and manipulation or application of the dispensed paste. Any suitable releasable locking means can be used for keeping the top cap 102 at a desired position. For example, a protrusion or a projection may be provided at one end of the top cap 102 towards the hinge, and a complementary void or orifice may be provided on the stop for accepting the protrusion or projection when the top cap 102 is opened to temporarily lock the top cap 102 in position. Other types of releasable locking means for the top cap 102 are also contemplated, such as spring-loaded locks, friction locks, or snap-locks.

All headings are for the convenience of the reader and should not be used to limit the meaning of the text that follows the heading, unless so specified. Various changes and departures may be made to the present invention without departing from the spirit and scope thereof. Accordingly, it is not intended that the invention be limited to that specifically described in the specification or as illustrated in the drawings, but only as set forth in the claims. Although the invention has been described and illustrated with respect to exemplary embodiments thereof, it should be understood by those skilled in the art that the foregoing and various other changes, omissions, and additions may be made therein and thereto, without parting from the spirit and scope of the present invention.

What is claimed is:

1. An apparatus for dispensing a measured amount of paste, comprising:

a flexible container for paste, comprising a closed end, a peripheral wall, and an open outlet;

a top cap comprising a top surface and a bottom surface, the top cap hingedly attached to the open outlet, the bottom surface of the top cap disposed to cover the open outlet in a closed position and uncover the open outlet in an open position;

a scooper attached to the bottom surface of the top cap in a substantially perpendicular orientation, the scooper configured to dip into the container in the closed position and scoop out a measured amount of paste from the container in an open position, wherein the scooper comprises side-walls; and an extension member positioned toward the open outlet which contacts the scooper when the top cap is in the closed position, wherein the extension member allows for a space behind the scooper and the peripheral wall.

2. The apparatus of claim 1, wherein the open outlet, the top cap, and the scooper have substantially rectangular-shaped configurations.

3. The apparatus of claim 1, wherein the scooper is shorter than the top cap leaving an opening in the open outlet when the top cap is in the open position.

4. The apparatus of claim 1, wherein the peripheral wall tapers to the open outlet.

5. The apparatus of claim 1, wherein the peripheral wall further comprises a seal positioned toward the open outlet which contacts the scooper when the top cap is in the closed position and keeps paste form building up in the space behind the scooper.

6. The apparatus of claim 1, wherein the open outlet and the top cap further comprise complementary engaging means to releasably secure the top cap in the closed position.

7. The apparatus of claim 6, wherein the complementary engaging means is selected from the group consisting of male-female fasteners and snap-lock retainers.

8. The apparatus of claim 1, wherein the open outlet further comprises a substantially flat panel with one or more apertures, wherein the paste is pushed through the one or more apertures and the flat panel blocks excess paste from exiting the container.

9. A system for dispensing a measured amount of paste, comprising:

a squeezable paste container having an open end;

a cap comprising an elongated lip attached at a substantially perpendicular orientation to the cap;

a hinge connecting the cap to the open end of the paste container, wherein the cap covers the open end of the paste container in a closed position and uncovers the open end of the paste container in an open position; and a seal positioned toward the open end, wherein the seal contacts the elongated lip when the cap is in the closed position and keeps paste form building up behind the elongated lip;

wherein the elongated lip of the cap dips into the paste container when the cap is in the closed position and scoops out a measured amount of paste from the paste container when the cap moves to the open position.

10. The system of claim 9, wherein the open end, the cap, and the elongated lip have substantially rectangular-shaped configurations.

11. The system of claim 9, wherein the elongated lip is shorter than the cap leaving an opening in the open end when the cap is in the open position.

12. The system of claim 9, wherein the paste container tapers to the open end.

13. The system of claim 9, wherein the paste container further comprises:

a spacer positioned anterior to the hinge which contacts the elongated lip when the cap is in the closed position, wherein the spacer allows for a space behind the elongated lip and an inner surface of the paste container.

14. The system of claim 9, wherein the open end and the cap further comprise releasable securing means to lock the cap in the closed position.

15. The system of claim 14, wherein the releasable securing means is selected from the group consisting of fasteners and retainers.

16. The system of claim 9, wherein the elongated lip further comprises side-walls.

17. The system of claim 9, wherein the open end further comprises a substantially flat panel with one or more apertures, wherein the paste is pushed through the one or more apertures and the flat panel blocks excess paste from exiting the container.

18. An apparatus for dispensing a measured amount of paste, comprising:

a flexible container for paste, comprising a closed end, a peripheral wall, and an open outlet;

a top cap comprising a top surface and a bottom surface, the top cap hingedly attached to the open outlet, the bottom surface of the top cap disposed to cover the open outlet in a closed position and uncover the open outlet in an open position;

a scooper attached to the bottom surface of the top cap in a substantially perpendicular orientation; and one or more side walls coupled to the scooper, the one or more side walls projecting away from a surface of the scooper;

wherein, the scooper is configured to dip into the container in the closed position and scoop out a measured amount of paste from the container in an open position.

19. The apparatus of claim 18, wherein the peripheral wall further comprises a seal positioned toward the open outlet which contacts the scooper when the top cap is in the closed position and keeps paste form building up in the space behind the scooper.

20. The apparatus of claim 18 wherein the open outlet further comprises a substantially flat panel with one or more apertures, wherein the paste is pushed through the one or more apertures and the flat panel blocks excess paste from exiting the container.

* * * * *